US007627265B2

(12) United States Patent
Gayne et al.

(10) Patent No.: US 7,627,265 B2
(45) Date of Patent: Dec. 1, 2009

(54) SEAL AND SEAL ASSEMBLY FOR AN IMAGE FORMING APPARATUS

(75) Inventors: Jarrett Clark Gayne, Lexington, KY (US); Nicholas Matthew Sullivan, Oak Ridge, TN (US)

(73) Assignee: Lexmark International, Inc., Lexington, KY (US)

( * ) Notice: Subject to any disclaimer, the term of this patent is extended or adjusted under 35 U.S.C. 154(b) by 89 days.

(21) Appl. No.: 11/623,104

(22) Filed: Jan. 15, 2007

(65) Prior Publication Data

US 2008/0170879 A1 Jul. 17, 2008

(51) Int. Cl.
*G03G 15/08* (2006.01)

(52) U.S. Cl. ..... 399/103; 399/105

(58) Field of Classification Search ..... 399/103, 399/98, 102, 105

See application file for complete search history.

(56) References Cited

U.S. PATENT DOCUMENTS

| | | | | |
|---|---|---|---|---|
| 4,821,672 | A | 4/1989 | Bruno | |
| 5,475,467 | A | 12/1995 | Watanabe et al. | |
| 5,502,547 | A | 3/1996 | Shirai | |
| 5,550,617 | A | 8/1996 | Odagawa et al. | |
| 5,671,673 | A | 9/1997 | Boose et al. | |
| 5,697,021 | A | 12/1997 | Watanabe et al. | |
| 5,794,101 | A * | 8/1998 | Watanabe et al. | 399/103 |
| 5,875,378 | A | 2/1999 | Campbell et al. | |
| 6,021,297 | A | 2/2000 | Campbell et al. | |
| 6,078,771 | A | 6/2000 | Buchanan et al. | |
| 6,471,773 | B1 | 10/2002 | Atkins | |
| 6,487,383 | B2 | 11/2002 | Buchanan et al. | |
| 6,629,496 | B1 | 10/2003 | Boose et al. | |
| 6,697,594 | B1 | 2/2004 | Murphy et al. | |
| 6,832,551 | B2 | 12/2004 | Jendroska et al. | |
| 6,985,683 | B2 * | 1/2006 | Foster et al. | 399/103 |
| 2003/0012580 | A1 * | 1/2003 | Miyabe | 399/103 |
| 2003/0118364 | A1 * | 6/2003 | Kamimura | 399/103 |
| 2003/0235438 | A1 | 12/2003 | Tatsumi | |
| 2005/0013890 | A1 | 1/2005 | Chapman et al. | |
| 2006/0024085 | A1 * | 2/2006 | Sato et al. | 399/103 |
| 2007/0140729 | A1 * | 6/2007 | Carter et al. | 399/103 |

* cited by examiner

*Primary Examiner*—David M Gray
*Assistant Examiner*—Geoffrey T Evans
(74) *Attorney, Agent, or Firm*—Steven J. Grossman; John Victor Pezdek

(57) ABSTRACT

A seal assembly may be used to seal an interface between a roller and a frame in an image forming apparatus. The seal assembly may include an end seal configured to seal an end of a doctor blade in contact with the roller and a roll seal configured to seal a portion of an outer surface of the roller. The roll seal may include an extension located between the end seal and the roller. The roll seal may also include a toe portion that engages the developer frame to resist movement of the roll seal when the developer roll rotates against the roll seal. The seal assembly may be used in an image forming apparatus including, but not limited to, printers, copiers, faxes, multifunctional devices or all-in-one devices.

22 Claims, 3 Drawing Sheets

SEAL AND SEAL ASSEMBLY FOR AN IMAGE FORMING APPARATUS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None

BACKGROUND

1. Field of the Invention

The present invention relates to a seal within an image forming apparatus, and more particularly, to a roll seal that seals an interface between a developer roll and a developer frame.

2. Description of the Related Art

An image forming apparatus, such as an electrophotographic device, ink printer, copier, fax, all-in-one device or multi-functional device may use developing agents such as toner or ink, which may be disposed on media to form an image. The developing agent, such as toner, may be fixed to the media using an image fixing apparatus, which may apply heat and/or pressure to the toner. In a developer assembly in an image forming apparatus, there is a desire to seal the interface between the developer roll and the developer frame to prevent or minimize leakage of the developing agent. In conventional developer assemblies, the seals may not be adequate and may not stay in position as the developer roll rotates.

SUMMARY OF THE INVENTION

One exemplary embodiment of the present disclosure relates to a seal assembly for sealing an interface between a roller and a frame in an image forming apparatus. The seal assembly may include an end seal configured to seal a doctor blade in contact with the roller. The roll seal may include a sealing surface configured to seal at least a portion of an outer surface of the roller and an extension portion located between the end seal and the roller. The extension portion may have a reduced thickness or be tapered. In addition, the roll seal may include an end portion configured to engage the frame which upon engagement may provide a resistance in movement of the roll seal upon roller rotation.

Another exemplary embodiment of the present disclosure relates an assembly for sealing components in an image forming device which includes a frame and a roller rotatably mounted in that frame and having an outer surface. A blade may then be mounted with a portion of the blade in contact with the roller and at least one end seal positioned in the frame and configured to seal the blade to the roller. At least one roller seal may be located within the frame that may contact a portion of the outer surface of the roller, the roll seal including a sealing surface conforming to a portion of the outer surface of the developer roll, the roll seal including a first end located between the end seal and the roller.

Yet another exemplary embodiment relates to a roll seal for a flame and roller including a body portion and an arcuate sealing surface extending along a first side of the body portion configured to engage and seal a portion of the roller. At least one rib may be provided that extends along a second side of the body portion. The roll seal may include an end portion that is configured to engage the frame along with an extension portion. The extension portion may include a sealing surface wherein the extension portion may extend beyond the identified rib portion.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings wherein.

DETAILED DESCRIPTION

Figure 1:
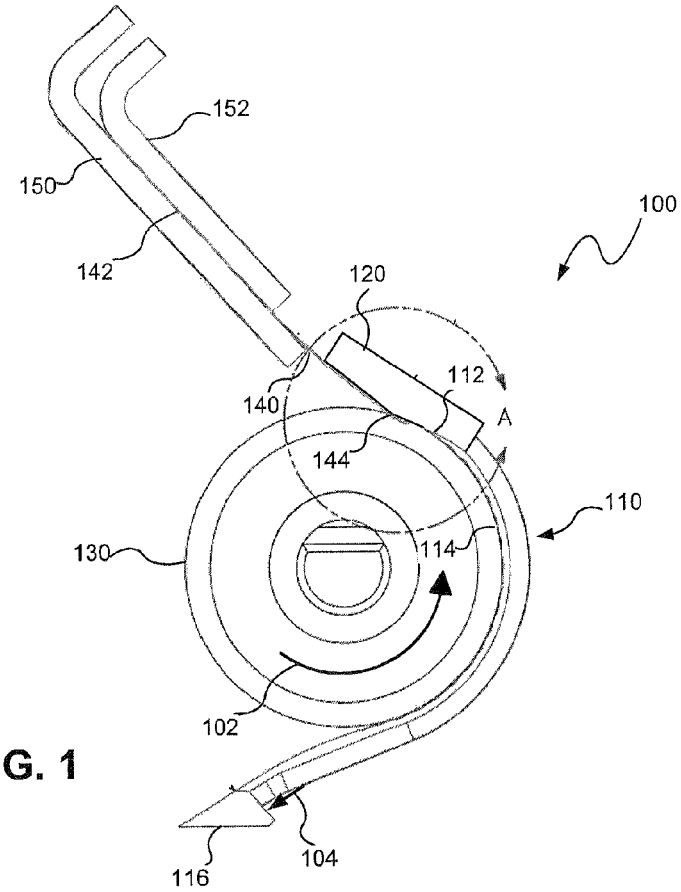
FIG. 1 is a side view of a seal assembly used to seal an exemplary developer roller.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

As alluded to above, the present disclosure relates to a roll seal and seal assembly for sealing an interface between a roller and a frame. The roller may include a developer roller and the frame may include a developer frame (as may be found in a laser printer) which may include a blade such as a doctor blade and an end seal for the doctor blade. While the disclosure herein is therefore described in such context, it should be appreciated that other configurations are contemplated. In addition, generally, the roll seal may engage and overlap an end seal at one end and may be secured against movement at the other end. The seal assembly may therefore be used, for example, in an image forming apparatus including, but not limited to, printers (e.g. a laser printer), copiers, faxes, multifunctional devices or all-in-one devices.

Figure 6:
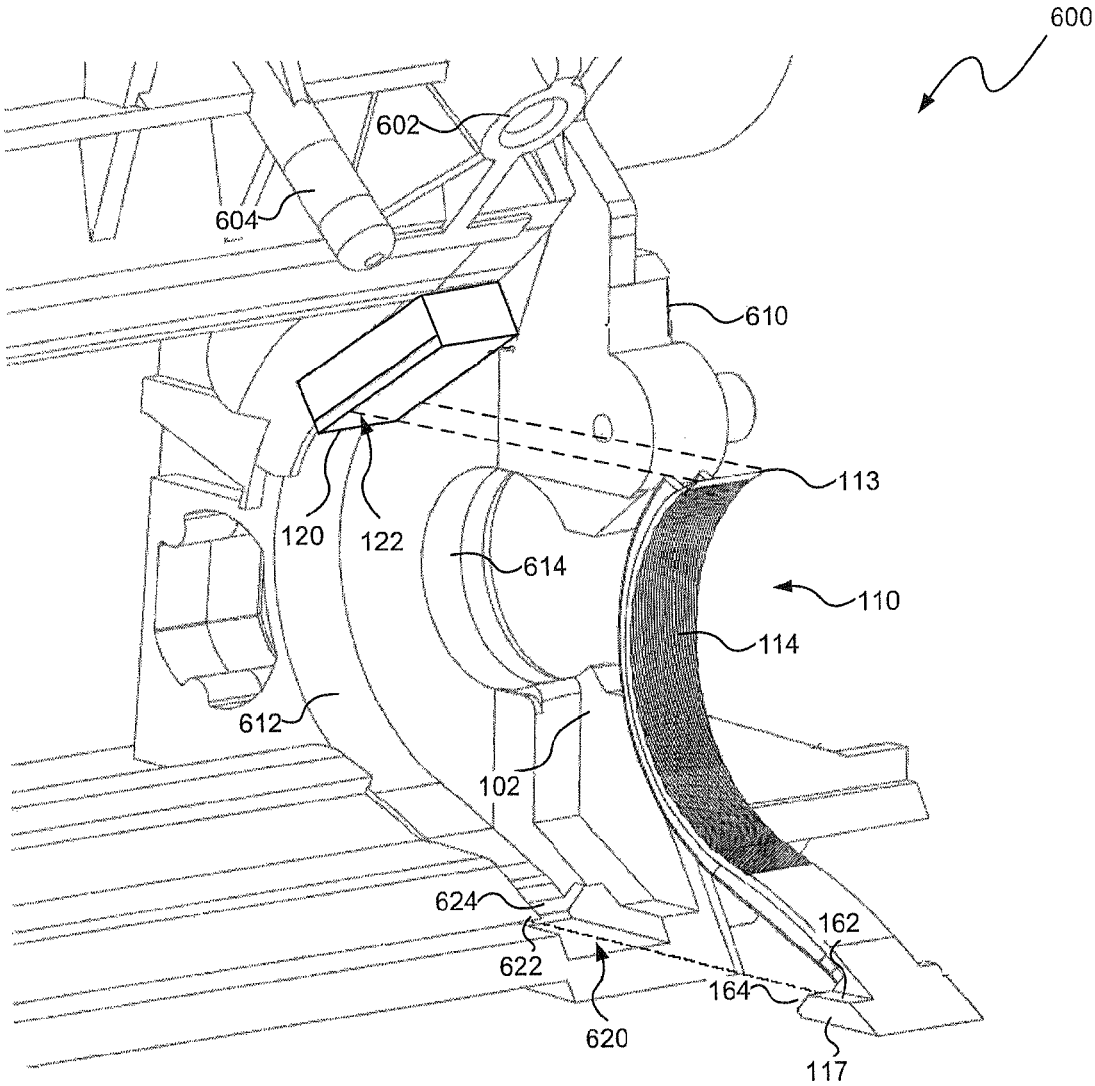
FIG. 6 is a perspective view of the exemplary roll seal and an end seal being located in a developer frame.

FIG. 1 illustrates an exemplary seal assembly 100 including a roll seal 110, consistent with one embodiment of the present invention. The roll seal 110 may include one end 112 (see FIG. 3) that engages and overlaps with an end seal 120 and another end 116 that may be secured against movement, for example, by a frame (e.g., as shown in FIG. 6 and described below). The roll seal 110 may also include a sealing surface 114 configured to seal against a portion of a developer roll 130 such that the seal assembly 100 seals the interface between the developer roll 130 and a developer frame (not shown) which may therefore prevent or minimize the passage of image forming material or developing agent (e.g., toner). As the developer roll 130 rotates against the roll seal 110 (e.g., in the direction of arrow 102), the developer roll 130 may apply a frictional force against the sealing surface 114 of the roll seal 110 and the developer frame (not shown) may apply a force to the end 116 of the roll seal 110 (e.g., in the direction of arrow 104) to secure the roll seal 110 against movement, as will be described in greater detail below.

In one embodiment, the end seal 120 may seal the end of a blade 140 (e.g., a doctor blade) contacting a surface of the developer roll 130. Although only one end is shown, end seals 120 may be used at each end of the blade 140. In general, the blade 140 may be used to control the thickness of image forming material (e.g., toner) on a surface of the developer roll 130. The blade 140 may include a portion 142 mounted or clamped, for example, between blade support members 150, 152 such that another portion of the blade 140 contact the developer roll 130. The support members 150, 152, with the blade 140 clamped therebetween, may be secured to a developer frame (not shown). The blade 140 may be mounted such that the amount of force of the blade 140 may be varied, for example, by adjusting the relative positions of the support members 150, 152.

The end seal(s) 120 may be made of any material capable of reducing the amount of image forming material from passing the end seal(s) 120. In one example, the end seal(s) 120 may include a relatively low modulus polymeric type material with a flex modulus of less than about 200,000 psi. The end seals may include, for example, a relatively low density (about 4.0 to about 8.0 pounds per cubic foot) open-celled polyester urethane foam having a 25 percent Compression Load Deflection (CLD 25%) of about 0.6 (per ASTM D-3574-86). Other types of flexible foams such as polyether urethane, silicone or rubber may also be suitable. The end seals may also include or be composed of abrasion resistant material such as a non-woven material. An example of such non-woven material is a polyester ultra-microfiber non-woven with a non-fibrous polymeric binder such as a polyurethane binder. For example the non-woven material may be Ultrasuede® from Toray (Ultrasuede (America)), Inc., which may be adhered to the bottom surface of the end seals to bear against the developer roller. In addition, the non-woven material for the end seals may have a basis weight of about 100-1000 g/m$^2$, a denier of about 0.01-0.2, a thickness of about 0.1-5.0 mm and a surface abrasion resistance (ASTM D3886 P800) of about 100-10,000, and values greater than 10,000, including all ranges and values between 100-10,000.

One example of the blade 140 is a cantilevered "check-mark" doctor blade. The blade may be made of a metal (e.g., stainless steel) or a plastic material and may have a thickness of about 0.005-0.010 inches. If the blade 140 is a "check-mark" doctor blade, a portion of the blade 140 may contact the developer roll 130 at a tangential contact point and a portion of the blade 140 may extend away from the tangential contact point. At the ends of the blade (e.g., one end is shown in FIG. 1), the end seal 120 may engage an end portion 144 of the blade 140 (see FIG. 2), for example, in the manner disclosed in greater detail in U.S. patent application Ser. No. 11/201,439, which is incorporated herein by reference.

Figure 2:
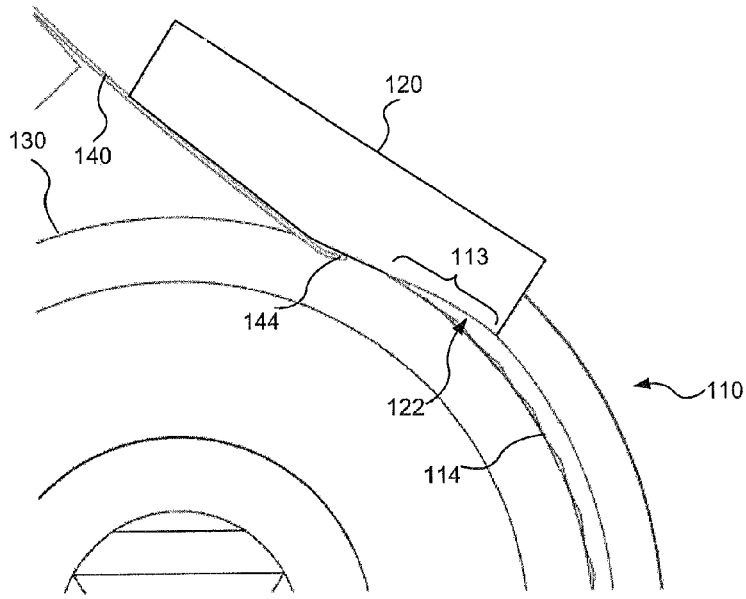
FIG. 2 is an enlarged side view of section A in FIG. 1.
Figure 3:
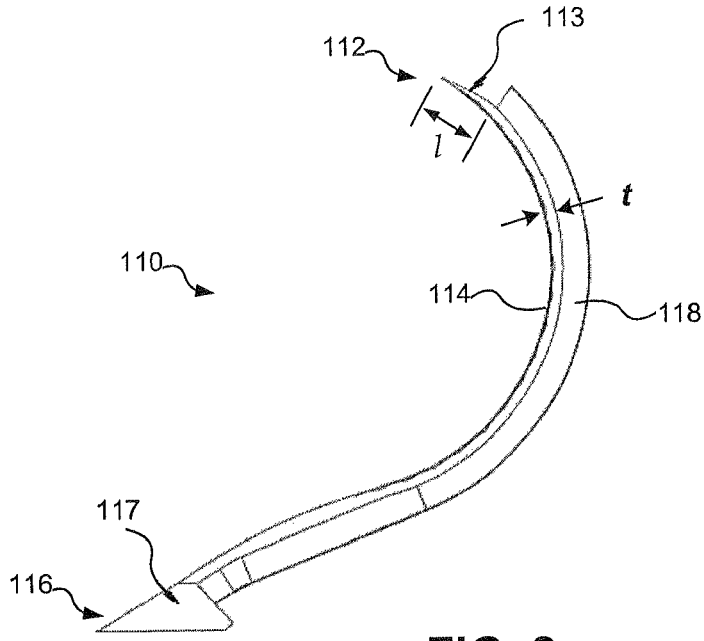
FIG. 3 is a side view of an exemplary roll seal.

Referring to the enlarged view in FIG. 2, as well as FIG. 3, the roll seal 110 includes an extension 113 extending between the end seal 120 and the developer roll 130. The extension 113 of the roll seal 110 may overlap at least a portion of the sealing surface 122 of the end seal 120, and the sealing surface 114 extends onto at least a portion of the extension 113. In one embodiment, the extension 113 may stop below the end portion 144 of the blade 140 engaged by the end seal 120. The end of the extension 113 may be spaced from the end portion 144 of the doctor blade 140 by an amount that may prevent the extension 113 from contacting the end portion 144 when the roll seal 110 stretches, for example, as a result of elastic deformation cause by friction forces and heat. In one embodiment, the extension 113 may overlap at least about 1 mm or more of the end seal 120 and may be spaced from the end portion 144 of the doctor blade 140 by at least about 1 mm or greater. In one specific example, the extension 113 may overlap about 1.5 mm or more of the end seal 120 and may be spaced from the end portion 144 of the doctor blade 140 by about 2.5 mm or greater.

Figure 4:
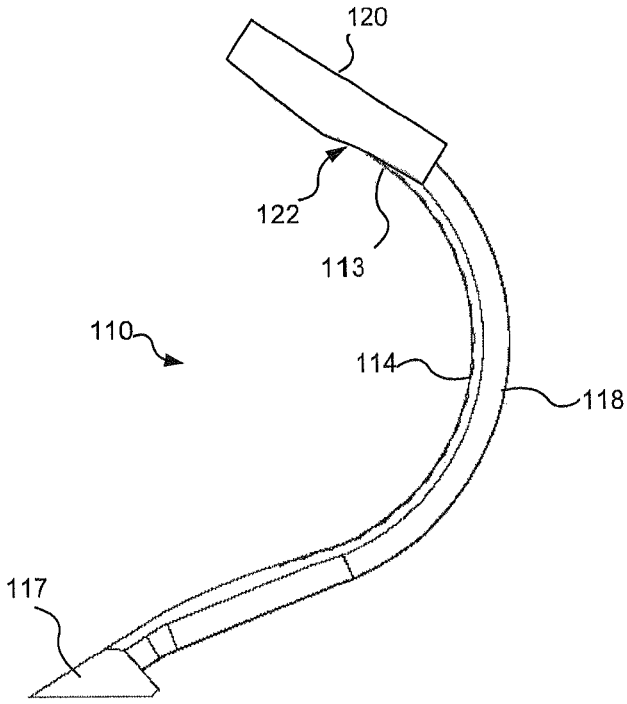
FIG. 4 is a side view of the exemplary roll seal shown in FIG. 3 overlapping an end seal.
Figure 5:
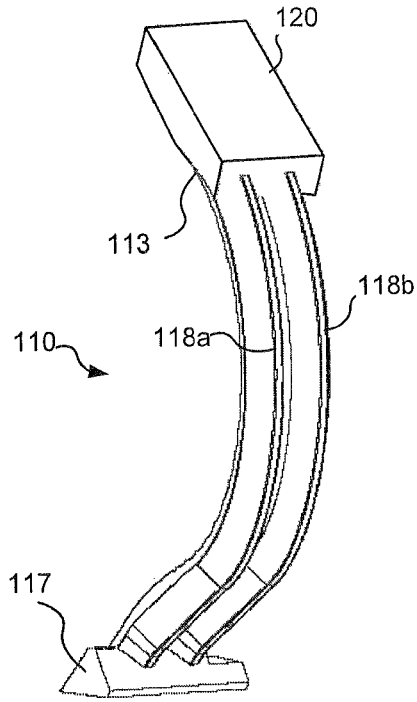
FIG. 5 is a perspective view of the exemplary roll seal and end seal shown in FIG. 4.

As shown in FIGS. 3-5, one embodiment of the roll seal 110 includes a pre-formed, elongated arcuate shaped body with the above mentioned extension 113 at one end 112 to engage the end seal 120 and a toe portion 117 at the other end 116 which may engage the developer frame. As can be seen in FIG.5, the toe portion 117 is wedge-shaped or triangularly shaped and has a width that is greater than the width of the arcuate shaped body while the extension 113 has a width the is substantially the same as that of the body. In one example, the extension 113 may have a length l of about 1.5mm, although other lengths are possible to provide the desired overlap as mentioned above. As shown in FIG. 4, the extension 113 may include an end that has a reduced thickness such that the extension 113 may ultimately lie nearly flush against the overlapping sealing surface 122 of the end seal 120. By reduced thickness it may understood that the roll seal may have a thickness "t", and the end section may have a reduced thickness, e.g. (0.01-0.99)(t). In addition, the end section may be tapered, which may be understood as having change in thickness ($\Delta t$) over length l. As shown in FIG. 3, the thickness of the extension 113 tapers from that of the arcuate-shaped body to a point over its length.

One embodiment of the roll seal 110 may be similar to the type known as a J-seal. The J-seal may include a relatively flexible and relatively low modulus material such as urethane, natural or synthetic rubber (e.g., cis-polyisoprene) or fluorocarbon polymer having a Shore A hardness of greater than or equal to about 55, and more specifically, having a value of about 55-110, as well as all values and increments therein. The sealing surface 114 may also include grooves known to those skilled in the art for use on J-seals. Those skilled in the art will recognize that other shapes and configurations may be used for the roll seal.

The roll seal 110 may also include at least one rib 118 (sometimes referred to as compression ribs) on the side of the roll seal 110 opposite the sealing surface 114. The rib(s) 118 may extend from the toe portion 117 to the extension 113 such that the rib(s) 118 contact the end seal 120 (see FIGS. 4 and 5). The sealing surface 114 may extend beyond the rib(s) 118 and along at least a portion of the extension 113. In the illustrated and exemplary embodiment, a pair of ribs 118*a*, 118*b* may extend along each side of the roll seal 110, although other configurations are possible.

Referring to FIG. 6, the roll seal 110 may be received in a developer frame 610 of a developer assembly 600. The developer assembly 600 may be part of a cartridge used in a printer or other image forming apparatus. The end seals 120 (only one is shown) may be secured within the developer frame 610, for example, by adhering the end seals 120 to a surface of the developer frame 610. The roll seal 110 may be positioned within a roll seal seat 612 in the developer frame 610 with the extension 113 positioned against the overlapping portion of the sealing surface 122 of the end seal 120.

The toe portion 117 may be positioned within a slot 620 of the developer frame 610. The slot 620 may include surfaces or portions 622, 624 that engage surface or portions 162, 164 of the toe portion 117 to constrain the toe portion 117 within the developer frame 610. Thus, the roll seal 110 may engage and become relatively immobilized in the developer frame 610. In one embodiment, only the toe portion 117 is engaged into the developer frame 610, allowing the remainder of the roll seal 110 to stretch in the direction of rotation of the developer roll 130.

The developer roll (not shown) may be rotatably mounted within a bearing portion 614 of the developer frame 610. When a developer roll, such as developer roll 130 shown in FIG. 1, is installed within the developer frame 610, the developer roll may bias the roll seal 110 against the developer frame 610 and end seal 120. Referring back to FIG. 1, as the developer roll 130 rotates (e.g., in the direction of the arrow 102), frictional forces may stretch the roll seal 110 and positively locate the ends of the compression ribs 118 against the bottom of the end seal 120. During such rotation, the toe portion 117 may hold or retain the roll seal 110 within the developer frame 610 so that the roll seal continue to provide an ability to seal and control, e.g., toner from passing through the seal. Accordingly, the toe portion may retain the roll seal within the developer frame to resist that amount of movement that would otherwise lead to some increase in undesirable toner leakage.

The blade (not shown in FIG. 6) may also be mounted to the developer frame 610. In one embodiment, the developer frame 610 may include a fastening portion 602, such as a threaded hole, that receives a fastener (not shown), such as a screw, to secure the blade support members 150, 152 shown in FIG. 1 to the developer frame 610. The developer frame 610 may also include an alignment pin 604 configured to engage a hole in the support members 150, 152 to align the blade 140.

Thus, the developer frame 610 may receive and secure the roll seal 110, the end seal 120, the developer roll 130, and the blade 140, for example, in the interlocking relationship shown in FIG. 1. Overlapping the extension 113 of the roll seal 110 with the end seal(s) 120 may prevent the developer roll 130 from shearing the end seal(s) 120 out of position. By engaging the toe portion 117 with the developer frame 610, the roll seal 110 may be maintained in its sealing position against the rotating developer roll 130.

The foregoing description of several methods and an embodiment of the invention has been presented for purposes of illustration. It is not intended to be exhaustive or to limit the invention to precise steps and/or forms disclosed, and obviously many modifications and variations are possible in light of the above teachings. It is intended that the scope of the invention be defined by the claims appended hereto.

The invention claimed is:

1. A seal assembly for sealing an interface between a roller and a frame in an image forming apparatus comprising:

an end seal mounted on said frame and configured to seal a doctor blade in contact with said roller; and a one-piece roll seal including:

(i) a wedge-shaped toe portion for engaging said frame allowing said one-piece roll seal to resist movement when said roller rotates against said roll seal; and (ii) an arcuate portion connected to said wedge-shaped toe portion and having a grooved sealing surface configured to seal at least a portion of an outer surface of said roller; said arcuate portion having a width that is less than the width of said wedge-shaped toe portion and a tapered extension portion opposite said wedge-shaped toe portion, said tapered extension portion being positioned between said end seal and said roller when said one-piece roll seal is installed.

2. The seal assembly of claim 1 wherein said one-piece roll seal includes at least one rib extending along a portion of said arcuate portion and terminating at said tapered extension portion, said rib extending from a surface opposite said grooved sealing surface.

3. The seal assembly of claim 2 wherein an end of said at least one rib contacts said end seal.

4. The seal assembly of claim 1 wherein said one-piece roll seal has a thickness t and said extension portion has thickness equal to about t at the end connected to said arcuate portion and tapers to a point at the opposite end.

5. The seal assembly of claim 1 contained within an image forming device cartridge.

6. The seal assembly of claim 1 wherein said image forming device is a laser printer.

7. An assembly for sealing components in an image forming device comprising:

a frame;

a developer roller rotatably mounted in said frame having an outer surface;

a blade mounted in said frame with a portion of the blade in contact with said outer surface of said developer roller;

at least one end seal positioned in said frame configured to seal an end of said blade and a corresponding end of said developer roller; and at least one one-piece roll seal located in said frame and contacting a portion of the outer surface of said developer roller, said at least one one-piece roll seal including:

(i) a wedged-shaped toe portion for engaging said frame allowing said at least one one-piece roll seal to resist movement when said developer roller rotates against said at least one one-piece roll seal; and (ii) an arcuate portion connected to said toe portion, said arcuate portion having a grooved sealing surface conforming to a portion of said outer surface of said developer roller, a width that is less than the width of said wedge-shaped portion, and a tapered end portion opposite said wedge-shaped toe portion and located between said at least one end seal and said developer roller.

8. The assembly of claim 7 wherein said blade is positioned between said at least one end seal and said developer roller.

9. The assembly of claim 7 wherein said blade includes first and second ends and said at least one end seal comprises first and second end seals located at said first and second ends of said blade.

10. The assembly of claim 7 wherein said developer roller includes first and second ends and said at least one one-piece roll seal includes first and second one-piece roll seals located at said first and second ends of said developer roller.

11. The assembly of claim 7 wherein said at least one one-piece roll seal has a thickness t and said tapered end portion at one end tapers from said thickness t to a point at the other end of said tapered end portion.

12. The assembly of claim 7 wherein said image forming device is one of a laser printer and a cartridge for a laser printer.

13. The assembly of claim 7 wherein said tapered end portion overlaps a portion of said end seal.

14. The assembly of claim 7 wherein said at least one one-piece roll seal includes at least one rib extending along a portion of said arcuate portion and terminating adjacent said tapered end portion, said at least one rib projecting outwardly from a surface of said arcuate portion opposite said sealing surface.

15. A one-piece roll seal for a frame and roller comprising:

a body portion and a grooved arcuate sealing surface extending along a first side of the body portion configured to engage and seal a portion of said roller;

at least one rib extending along a second side of said body portion;

a wedge-shaped toe portion on an end of said body portion configured to engage said frame, said wedge-shaped body portion having a width greater than the width of said body portion; and a tapered extension portion on said body portion opposite said wedge-shaped toe portion said tapered extension portion including a portion of the sealing surface wherein said tapered extension portion extends beyond said rib.

16. The one-piece roll seal of claim 15 wherein said wedge-shaped toe portion upon engagement to said frame imparts resistance to movement of said one-piece roll seal upon rotation of said roller.

17. The one-piece roll seal of claim 15 wherein said one-piece roll seal has a thickness t and said tapered extension portion tapers from said thickness t adjacent said body portion to a point.

18. The one-piece roll seal of claim 15 located in an image forming device.

19. The one-piece roll seal of claim 15 located in an image forming device cartridge.

20. The one-piece roll seal of claim 15 wherein said frame includes an end seal adjacent an end of said roller and said tapered extension portion is between said end seal and said roller and overlaps a surface of said end seal facing said roller.

21. A one-piece roll seal for a frame and roller comprising:

an elongated body portion and a grooved arcuate sealing surface extending along a first side of the body portion configured to engage and seal a portion of said roller;

at least one rib extending along a second side of said body portion;

a wedge-shaped toe portion on one end of said body portion configured to engage said frame and having a width that is greater than the width of said body portion; and a tapered extension portion on said body portion opposite said toe portion, said tapered extension portion including a portion of the sealing surface wherein said tapered extension portion extends beyond said rib.

22. The one-piece roll seal of claim 21 comprised of a material selected from a group consisting of: a urethane, a natural rubber, a synthetic rubber, a fluorocarbon polymer having a Shore A hardness of greater than or equal to about 55 to about 110, including all values and increments therein.

* * * * *